United States Patent [19]

Gooch

[11] Patent Number: 4,480,652

[45] Date of Patent: Nov. 6, 1984

[54] SPRING COVERING DEVICE

[76] Inventor: Charles W. Gooch, P.O. Box 44, Chapmansboro, Tenn. 37035

[21] Appl. No.: 9,255

[22] Filed: Feb. 2, 1979

[51] Int. Cl.[3] ..... B63B 17/02

[52] U.S. Cl. ..... 135/88; 160/238

[58] Field of Search ..... 135/6, 5 R; 9/1.5; 160/238

[56] References Cited

U.S. PATENT DOCUMENTS

| | | | |
|---|---|---|---|
| 2,826,523 | 3/1958 | Blaszkowski | 160/238 X |
| 2,965,113 | 12/1960 | Russo | 135/6 |
| 2,997,277 | 8/1961 | Schwartz | 135/5 R |
| 3,241,899 | 3/1966 | Donker | 160/238 X |
| 3,338,290 | 8/1967 | Seruis | 160/238 |
| 3,499,680 | 3/1970 | Stroebel | 160/238 X |
| 4,075,723 | 2/1978 | Bareis et al. | 135/6 |

*Primary Examiner*—J. Karl Bell

*Attorney, Agent, or Firm*—Cushman, Darby & Cushman

[57] ABSTRACT

A simple covering mechanism for use as an awning, tent, boat cover, or the like, and a method of utilization thereof. The covering mechanism includes a self-coiling continuous sheet of substantially liquid impermeable material having an upward bow when uncoiled. The sheet is mounted at a first end thereof and is releasably mounted at a second end thereof when the sheet is in an uncoiled position so that the sheet extends generally horizontally with an upward bow when uncoiled. The sheet may be constructed of a single piece of plastic heat set in its coiled position, or may include a cloth covering for ribs that provide the self-coiling function.

2 Claims, 7 Drawing Figures

Fig. 2e
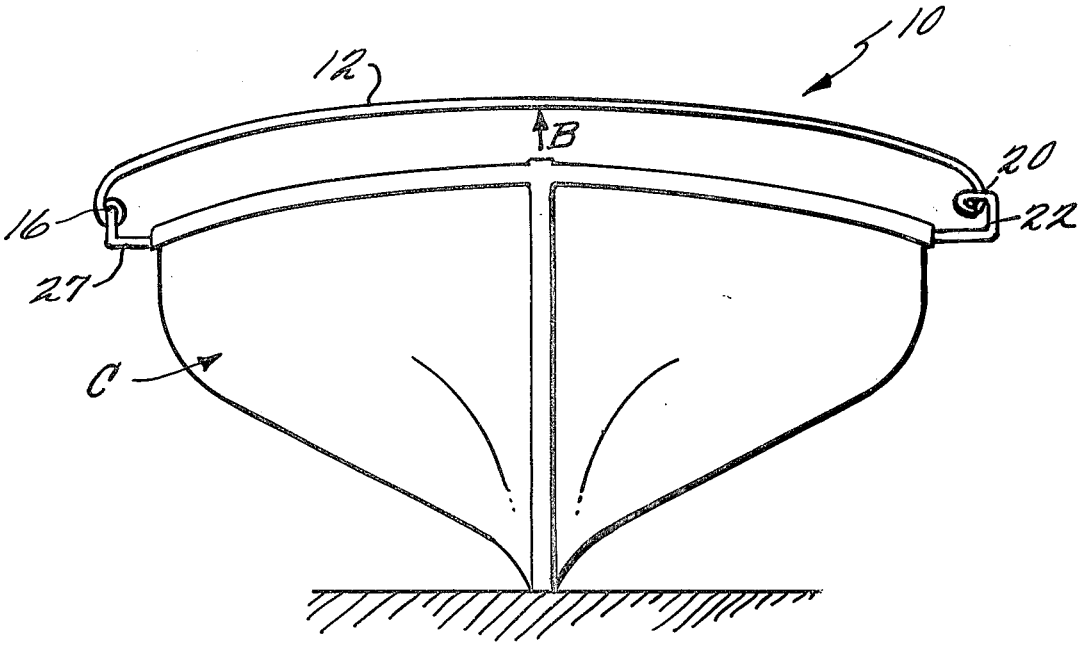
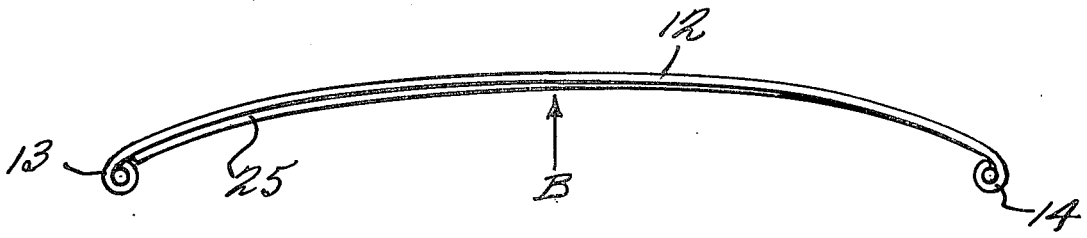
Fig. 3

SPRING COVERING DEVICE

BACKGROUND AND SUMMARY OF THE INVENTION

In many situations it is desirable to have a covering mechanism for a wide variety of uses, such as for use as a tent, awning, boat top or cover, or for covering a wide variety of other structures. Conventional coverings normally include a piece of substantially liquid impermeable cloth or other material which is merely draped over the structure to be covered, or held taut by a metal frame or the like in the case of awnings and tents. Such coverings often sag, which results in the collection of water rather the shedding of water and can impair their ultimate functioning, and often times the structures are cumbersome to place over the structure to be covered, and are difficult to remove for disposition in a position in which the covering mechanism may be readily used for subsequent covering.

According to the present invention, a simple covering mechanism is provided that is extremely versatile, which has excellent abilities for shedding water, and prevents collection of the water and subsequent sag. The covering mechanism is self-retractable into a position wherein it can be readily removed back into covering position. The covering mechanism basically comprises a self-coiling continuous sheet of substantially liquid impermeable material, having an upward bow when uncoiled, and having first and second ends. Means are provided for mounting the first end of the sheet for supporting the first end whether the sheet is in a coiled or uncoiled position, and means are provided for mounting the second end of the sheet for supporting the second end when the sheet is in an uncoiled position so that the sheet extends generally horizontally with an upward bow. The upward bow facilitates the shedding of water and prevents water collection, with subsequent sag. Due to the self-coiling nature upon release of the mechanism from its uncoiled position, it will move back to its coiled, uncovering position again readily available for movement back to its covering position.

The self-coiling continuous sheet may be constructed in a number of manners. One preferred manner is to make the sheet of an integral piece of plastic material, such as from an extruded thermoplastic polymer sheet that is heat set in its coiled position. A wide variety of commercially available plastics are suitable, including high impact polystyrene and polyethylene. The sheet may include a plurality of ribs of various profiles and cross-sections, the ribs being provided for support or for providing the self-coiling action. For instance, the sheet may comprise a flexible material (e.g. a substantially liquid impermeable cloth) covering the ribs, with the ribs supplying a force for self-coiling of the sheet. The ribs may be made of spring steel or a suitable plastic, such as an extruded thermoplastic polymeric material heat set in a coiled position. Cross springs and stiffeners may also be provided, as well as pre-stress tension or keystone arch tension when the covering mechanism is anchored in covering position to aid the supportive ability of the upward bow.

According to the method of the present invention covering of a structure is provided utilizing a self-coiling continuous sheet of substantially liquid impermeable material having first and second ends. The method includes the steps of mounting the first end of the sheet adjacent the structure so that the first end is supported whether the sheet is in a coiled or uncoiled position; operatively moving the second end of the sheet away from the first end to uncoil the sheet over the structure, until the sheet is substantially taut in an uncoiled position, extending generally horizontally with an upward bow; and then latching the second end of the sheet adjacent the structure so that the sheet is releasably maintained in its uncoiled position, covering the structure.

It is the primary object of the present invention to provide a simple, versatile, and effective covering mechanism, and a simple manner of operation thereof. This and other objects of the invention will become clear from an inspection of the detailed description of the invention, and from the appended claims.

BRIEF DESCRIPTION OF THE DRAWINGS

FIGS. 2*a* through 2*e* show sequential stages of an exemplary covering mechanism according to the present invention as it is moved from its uncovering to its covering position, FIG. 2*e* showing the covering mechanism in its covering position when used as a boat cover; and FIG. 3 is a side schematic view of another embodiment of the covering mechanism according to the present invention.

DETAILED DESCRIPTION OF THE DRAWINGS

Figure 1:
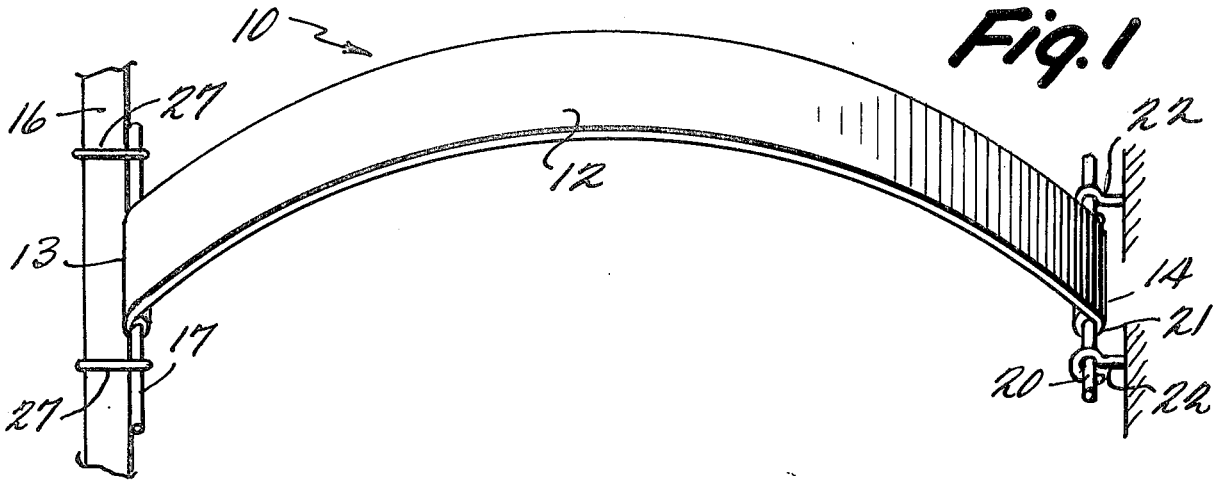
FIG. 1 is a perspective schematic view illustrating an exemplary covering mechanism according to the present invention in use as an awning.

A covering mechanism according to the present invention is shown generally at 10 in FIG. 1. In FIG. 1 the covering mechanism 10 is shown in use as an awning, while in FIG. 2*e* it is shown in use for covering a boat C.

The covering mechanism 10 includes a self-coiling continuous sheet 12 of substantially liquid impermeable material, having an upward bow B when uncoiled, and having first and second ends 13, 14 respectively. Means are provided for mounting the first end 13 of the sheet 12 for supporting the end 13 whether the sheet is in a coiled or uncoiled position. Such mounting means are shown in the drawings in the form of a rod 16 extending through a looped portion 17 formed in the first end 13 of the sheet 12. The mechanism 10 also includes means for mounting the second end 14 for releasably supporting the end 14 when the sheet 12 is in an uncoiled position, so that the sheet extends generally horizontally with the upward bow B. In the drawings, the second end mounting means are shown as a rod 20 extending through a loop 21 formed in the second end 14, and a pair of hooks 22 holding either end of the rod 20.

The sheet 12 may be constructed in a wide variety of ways. Preferably, the sheet 12 includes an integral piece of plastic, such as an extruded thermoplastic polymer sheet heat set in its coiled (FIG. 2*a*) position so that it always has a tendency to return to that position. A wide variety of commercially available plastics may be used for forming the sheet 12 including high impact polystyrene and polyethylene. Ribs 25 (see FIG. 3) of various profiles and cross-sections can be utilized for stiffening the sheet 12, or for providing the self-coiling action thereof. For instance, the ribs 25 may be integral with the sheet 12 and formed of the same plastic, and provide for stiffening thereof. Alternatively, the sheet 12 may comprise a flexible material (e.g. substantially water impermeable cloth) which covers the ribs 25, the ribs 25 being formed of spring steel or extruded thermoplastic polymeric material heat set in a coiled position, or the like, and suppplying a force for self-coiling of the sheet 12. Pre-stress tension or keystone arch tension when the mechanism 10 is in its covering position may aid the supportive ability of the bow B.

Figure 2B:
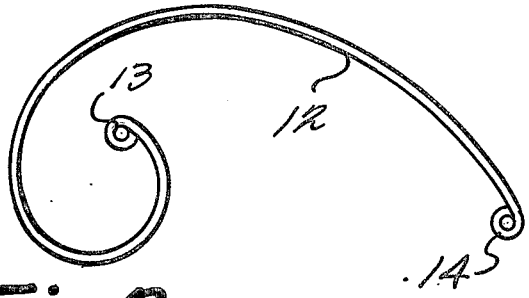
Figure 2A:
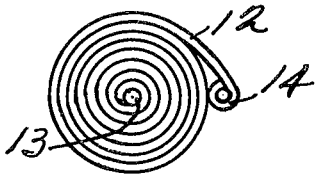
Figure 2C:
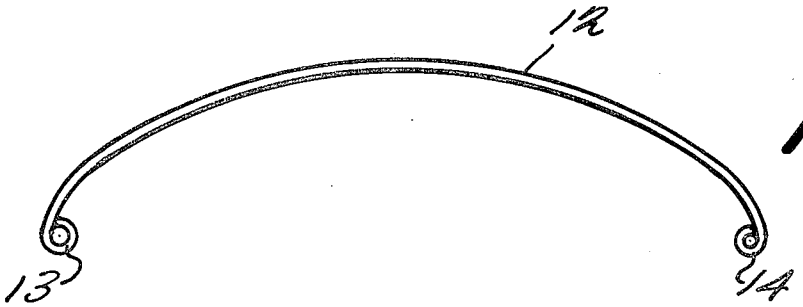
Figure 2D:
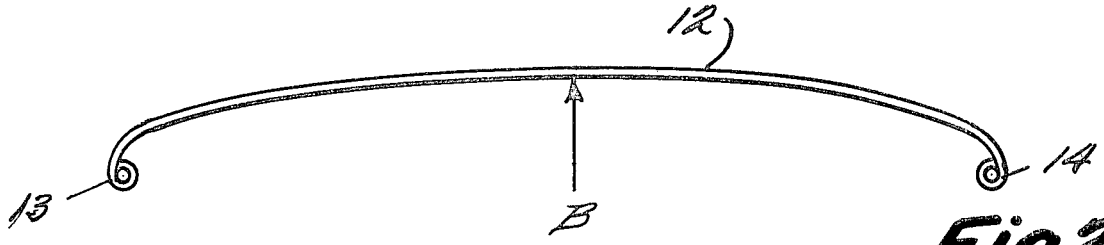

FIGS. 2*a* through 2*e* show the movement of the mechanism 10 from its coiled position (FIG. 2*a*) to its covering position (FIG. 2*e*). FIG. 2*a* shows the coiled position of the sheet 12, FIG. 2*b* shows a semi-coiled position as the second end 14 is being moved away from the first end 13, FIG. 2*c* shows an opened position, FIG. 2*d* shows an extended position, and FIG. 2*e* shows a taut position, a bow B still being provided in the taut position. The first end 13 is anchored by the rod 16 in place during uncoiling, and once the covering position is reached the rod 20 is latched in place by any suitable releasable latching means such as the hooks 22.

The method according to the present invention is for covering a structure—such as a boat C—utilizing the self-coiling continuous sheet 12 of substantially liquid impermeable material having first and second ends 13, 14. The method includes the steps of mounting the first end 13 of the sheet 12 adjacent the structure C—such as by a mounting structure 27 for receiving the ends of the rod 16—so that the first end 13 is supported whether the sheet is in a coiled (FIG. 2*a*) or uncoiled (FIG. 2*e*) position; operatively moving the second end 14 away from the first end 13 to uncoil the sheet over the structure, until the sheet is substantially taut in an uncoiled position extending generally horizontally, with an upward bow B (FIG. 2*e*); and latching the second end of the sheet adjacent the structure—as by placing rod 20 in operative engagement with the latching hooks 22—so that the sheet 12 is releasably maintained in the uncoiled position covering the structure C.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent mechanisms and methods.

What is claimed is:

1. A covering mechanism consisting essentially of:

a self-coiling continuous sheet of liquid impermeable material, and having a plurality of integral tapered ribs, and having an upward bow when uncoiled, and having first and second ends;

means for mounting said first end of said sheet for supporting said first end whether said sheet is in a coiled or uncoiled position; and means for mounting said second end of said sheet for releasably supporting said second end when said sheet is in an uncoiled position, so that said sheet extends generally horizontally with an upward bow.

2. A covering as recited in claim 1 wherein said ribs comprise extruded thermoplastic polymeric material heat set in a coiled position.

* * * * *